United States Patent [19]

Tominaga

[11] 3,974,675

[45] Aug. 17, 1976

[54] MOLDING DEVICE

[75] Inventor: Hiroshi Tominaga, Yokohama, Japan

[73] Assignee: Tokyo Sharyo Seizo Kabushiki Kaisha, Yokohama, Japan

[22] Filed: Oct. 30, 1974

[21] Appl. No.: 519,315

[52] U.S. Cl. ..... 72/56; 72/58; 72/61

[51] Int. Cl.[2] ..... B21D 26/02

[58] Field of Search ..... 72/56, 57–59, 72/61, 62; 29/421; 220/261, 281, 356, 357, 202, 208, 216, 221

[56] References Cited

UNITED STATES PATENTS

| | | | |
|---|---|---|---|
| 2,592,867 | 4/1952 | Cuq | 72/58 |
| 2,811,941 | 11/1957 | Conrad | 72/58 |
| 2,833,330 | 5/1958 | Love | 72/59 |
| 3,394,569 | 7/1968 | Smith | 72/56 |
| 3,535,901 | 10/1970 | Tominaga | 72/61 |
| 3,564,886 | 2/1971 | Nakamura | 72/62 |
| 3,623,347 | 11/1971 | Burk | 29/421 |
| 3,832,877 | 9/1974 | Tominaga et al. | 72/59 |

FOREIGN PATENTS OR APPLICATIONS

| | | | |
|---|---|---|---|
| 258,695 | 9/1926 | United Kingdom | 220/357 |

*Primary Examiner*—Carl E. Hall

*Attorney, Agent, or Firm*—Blum, Moscovitz, Friedman & Kaplan

[57] ABSTRACT

A hydraulic impact molding device for molding metal and like materials under instantaneously generated high hydraulic pressure is provided. The device includes a fitted, axially slidable cap which overfits the mold. A generally upward hydraulic force is internally generated within the mold for deforming a workpiece and the impact thereof is substantially absorbed by the slidable overfitting cap thereon which is axially slidably displaced thereby.

12 Claims, 14 Drawing Figures

MOLDING DEVICE

BACKGROUND OF THE INVENTION

This invention relates to a molding device and more particularly to a hydraulic impact molding device of the type wherein instantaneously high hydraulic pressure is generated for molding a metal workpiece or like workpiece.

Conventional hydraulic pressure molding devices are generally unsatisfactory because the wall thickness of the formed article is thinner than that of the workpiece to be deformed. As the workpiece is deformed to the mold cavity, the wall thickness thereof narrows as the diameter of the deformed workpiece increases, and cracks and other defects frequently occur in the molded article.

According to the instant invention, a molding device is provided wherein changes in wall thickness of the workpiece during deformation thereof are minimized, thereby concomitantly minimizing the number of defective molded articles produced thereby.

SUMMARY OF THE INVENTION

Generally speaking, in accordance with the invention, a molding device is provided having an axially slidable overfitted cap or cover of sufficient mass for absorbing the impact of the hydraulic force generated internally within the mold for deforming a workpiece, the cap being axially displaced a predetermined distance thereby. A generally upward hydraulic force is internally generated within the mold for deforming a workpiece removably mounted therein and the impact thereof, as aforesaid, is substantially absorbed by the slidable overfitting cap thereon which is axially slidably disposed thereby. This mold construction eliminates any need for locking bolts or like means which are otherwise conventionally employed with such molds for bolting the lid to the mold. The mold is, moreover, easier to charge with the workpiece and the molded article is more easily released therefrom.

In general, the mold includes a housing, upper and lower axially arranged reciprocable pistons slidably mounted in the housing and a mold cavity defined by at least one mold segment which is arranged between the pistons. The housing is provided with an upper instepped rim which provides a guide on which the overfitting cap is slidable. The cap is provided with a downstepped flange which is axially slidable on the guide when a hydraulic force is generated in the mold and impacted on the cover thereof. The cap flange fits complementarily into the elbow provided in the housing for defining the guide.

A hydraulic fluid inlet is provided in the housing and hydraulic fluid through channels are provided in each of the pistons. Both piston channels are substantially aligned over the inlet provided in the housing. Means for introducing a hydraulic fluid into mold and for generating an impact therein are provided and operatively connected to the mold.

The top surface of the upper piston and the bottom surface of the slidable cap define a hydraulic fluid storage chamber for storing an operative fluid therein. It is a feature of the molding device that any movable members thereof, other than the fitted cap which face the top chamber thereof and undergo compression by the hydraulic fluid stored therein, are generally larger in the downside direction, hydraulically, than in the upside direction thereof, while the surface area of the slidable cover is generally larger in the upside direction than in the downside hydraulic direction thereof.

Accordingly, it is an object of this invention to provide a hydraulic impact molding device having a simple and rugged construction which overcomes the aforementioned disadvantages of prior devices.

Another object of the invention is to provide a hydraulic impact molding device including a slidable overfitted cover which absorbs the upward hydraulic impact generated in the mold during a molding operation.

A further object of the invention is to provide a molding device wherein locking bolts and the like are not required for securing the cover on the device.

Still another object of the invention is to provide a mold device which is easier to charge than conventional devices and provides for the release of the molded object in a facile manner.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
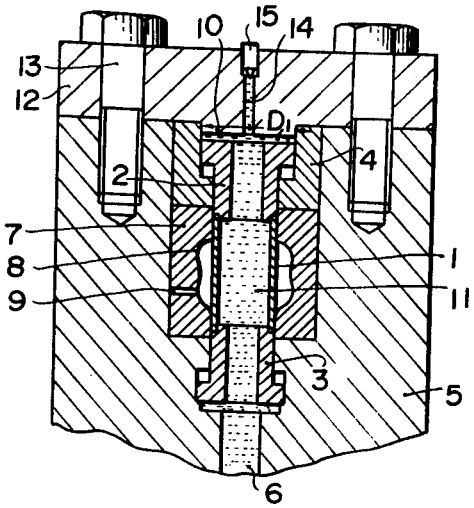
FIG-1 PRIOR ART
FIG. 1 is a sectional view of a prior art hydraulic impact molding device.

Referring now to the drawings, FIG. 1 shows a conventional hydraulic impact molding device wherein a tubular workpiece 1 such as steel pipe or the like is deformed to the configuration of a mold 7 defining a mold cavity 8 by the cooperative hydraulic action of a pair of upper and lower side thrust pistons 2 and 3. The pistons are substantially axially mounted above and below workpiece 1 and contiguous with respective opposed circular ends thereof. Each piston is provided with a substantially aligned hydraulic fluid channel. Upper side thrust piston 2 is slidably mounted on a piston guide 4, and the lower side thrust piston 3 is slidably mounted within mold housing 5. Upper and lower side thrust pistons 2 and 3 are vertically reciprocable, respectively, on guide 4 and within a cylinder space provided in mold housing 5.

A hydraulic fluid intake channel 6 is provided in housing 5 and is operatively connected to a hydraulic fluid inlet and impacting device (not shown) as well as to lower side thrust piston 3. An inner mold 7 is removably mounted in housing 5, around the outer periphery of workpiece 1 and its internal spacing therefrom defines a female mold cavity 8, having a shape corresponding to the shape of the molded article. Inner mold 7 is provided with an air vent 9 for evacuating air from the mold cavity. For charging of the mold with workpiece 1 and for discharging the molded article therefrom, inner mold 7 usually comprises two or three die segments.

Piston guide 4 is provided with an aperture in the floor thereof whereby piston 2 may hydraulically impact into workpiece 1. A downstep 10 provided in the underside of overfitting cap 12 overfits the mouth of piston guide 4 and forms a seal against the sidewall thereof for preventing leakage of hydraulic fluid into workpiece 1 therefrom. Overfitting cover 12 is releasably secured to housing 5 by a plurality of locking bolts 13.

An air vent 14, which can be opened or closed to the ambience by a two position escape valve 15, is provided in cover 12 and is operatively connected to the hydraulic through channel provided in upper side thrust piston 2. Valve 15 is hydraulically manipulable, for instance by air pressure, oil pressure or the like. The construction of suitable valve actuating means is known in the art.

According to the opertion of a conventional device of the type seen in FIG. 1, the workpiece 1 is mounted within mold 7 and opposed ends thereof contact respective interior ends of upper and lower thrust pistons 2 and 3, cover 12 being thereafter locked into housing 5 with bolts 13. A hydraulic fluid 11, for instance water, is charged inside workpiece 1 through hydraulic fluid intake passage 6 communicating with the hydraulic fluid pressure passage provided in the device whereupon air contained in the water is expelled through air escape 14 and escape valve 15, with valve 15 being subsequently closed.

A hydraulic pressure is instantaneously generated in, for instance, water 11 by a hydraulic impact generator (not shown) for thereby deforming workpiece 1 in accordance with the shape of the female mold 8. Generally, it is found that the wall thickness of the molded article decreases as the diameter of the deformed workpiece increases and cracks often occur in the molded article. According to the present invention, however, water pressure causes deformation of the workpiece 1, but at the same time upper and lower side thrust pistons 2 and 3 simultaneously compress the workpiece from both ends thereof and deform workpiece 1 into the shape of mold 8 for mitigating the reduction in workpiece thickness and thereby providing a molded article which has a relatively uniform thickness.

While water pressure generated inside the workpiece aids in deformation of the workpiece, it is radially and axially balanced. In general, the water pressure is generated in the device by a hydraulic impact generator (not shown) which is operatively connected to the mold proximate one end of the workpiece and provided in the other end of the device is the valved air vent, which is in a closed position at molding time. During the molding operation, the housing interior and elements mounted therein are pressurized and the force exerted thereon acts axially relative to the workpiece. When high level pressure is generated in the device or alternatively, when the pressure acts over a large area, a high pressure is exerted on downstep 10 provided on the underside of cover 12 and at the instant of molding an axial upward force is exerted thereon together with the cover 12 so as to push upwardly against the locking action of bolts 13.

Conventionally, the hydraulic impact generator generates a water pressure of approximately 1500 atms which translates to a force of about 75 tons being exerted on downstep 10 when the diameter thereof D1 is about 80 mm. If cover 12 is therefore bolted to the housing, then the bolts must be fixedly and tightly fastened thereto for withstanding that force.

It is found that the cover 12 for such conventional devices does not withstand the tremendous stress exerted thereon for long periods of time, and the inability is most apparent when the molding device has a wedge construction intended for easing charging thereof and releasing therefrom. The poor durability of the cover in turn affects the durability of the whole device. Prior solutions to the durability problems have resulted in more complex, large-sized devices which are difficult to operate and include inherent disadvantages of their own, such as longer working time.

Figure 2:
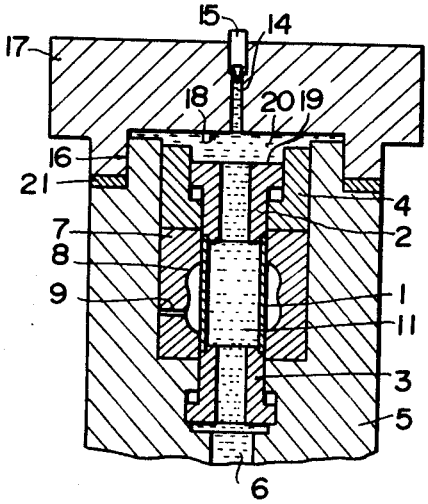
FIG. 2 is a sectional view of a hydraulic impact molding device embodiment constructed in accordance with the present invention.
Figure 3:
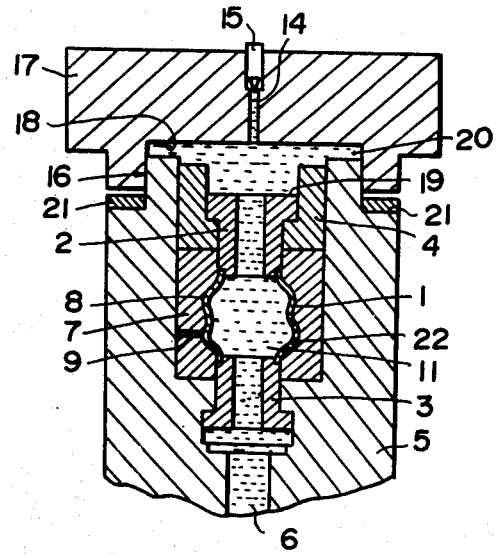
FIG. 3 is a sectional view of the embodiment shown in FIG. 2 with parts oriented to show the final stage of molding.

Referring now to FIGS. 2 and 3 wherein like numerals identify similar elements having similar functions, at the upper end of the housing 5 an instepped guide member 16 is provided and a complementary downstepped flange provided on cover 17 is slidable thereon for axially displacing cover 12 in response to an impact pressure generated in the device. The bottom surface 18 of cover 17 and the top surface 19 of upper side thrust piston 2 define a top chamber 20 therebetween for storing the operative hydraulic liquid, for instance water. Piston guide 4 opens into hydraulic chamber 20 and functions as a downside pressure receiving surface, but is not provided with an upside pressure receiving surface. The interior surface of the piston guide sidewall are compressed vertically during molding, but the force exerted thereon is offsetting and there is no net external effect produced thereby. Upper side thrust piston 2 is provided with a larger downside pressure receiving surface than an upward pressure receiving surface, and it is thereby arranged for balancing the upward force of the lower side thrust piston 3 when hydraulic pressure is generated in housing 5.

As shown in FIG. 2, to support the weight of cover 12 a buffer 21 is mounted on the elbow defining instepped guide 16 provided in housing 5. Buffer 21 is of substantially resilient construction, and may for instance be an oil pressure damper or the like. The molded article 22 is best seen in FIG. 3, which illustrates the relationship of parts at the conclusion of the molding process.

Figure 4:
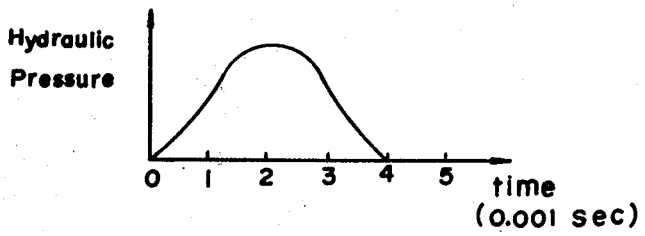
FIG. 4 is a graph illustrating the correlation between work time and hydraulic impact pressure generated in embodiments constructed in accordance with the invention.

The mode of operation of the device may be understood by reference to FIGS. 2 – 4. The workpiece 1 is mounted in mold 7 which is mounted in housing 5 with upper and lower side thrust pistons 2 and 3, piston 2 being slidably mounted in piston guide 4, and cover 17 being engaged on the housing and resting on buffer 21. Water 11 is charged fully into the mounted workpiece 1 and the top chamber 20 through the water passage 6 and corresponding channels provided in pistons 2 and 3, whereupon air in the water is expelled through air escape 14 by air escape valve 15, the latter being subsequently closed.

Next a high hydraulic spontaneous pressure is generated in the water within the mold from a hydraulic pressure generator (not shown) as graphically shown in FIG. 4, and the workpiece 1 is deformed in accordance with the shape of the female mold 8 into the finished article 22.

At the instant of hydraulic impact, the upper and lower side thrust pistons are subjected, respectively, to downward and upward forces and vertically compress workpiece 1 with an approximately balanced force. Piston guide 4 is simultaneously compressed along its interior sidewall area and along the top surface thereof by the hydraulic pressure generated in top chamber 20. The horizontal force exerted against the substantially vertical sidewall of piston guide 4 is balanced in every direction, and the vertical force exerted against the top surface thereof is downwardly directed. Piston guide 4 is not compressed along any other surfaces thereof and it is always pressed downwardly, in the direction of gravity, and prevents inner mold 7 from moving upwardly.

While pistons 2 and 3 are compressing inwardly to deform workpiece 1, upward pressure is exerted on surface 18 of cover 17, and cover 17 thereby initiates its accelerated upward movement. However, since cover 17 is suitably weighted, its kinetic acceleration is restrained until several g to 10 or more g (g standing for acceleration of gravity) is exerted thereon irrespective of the spontaneity of the water pressure. The retention time of the water pressure preferably is about 4 milliseconds as shown in FIG. 4, and correspondingly cover 17 slides upwardly only a few millimeters during this time. The upward forces exerted on cover 17 is also about several tens of kgs, and the maximum movement thereof is about a dozen or more millimeters. When the cover 17 is restored to its original position by the pull of gravity at the conclusion of the pressure cycle buffer 21 prevents cover 17 from impacting directly against housing 5.

The embodiment includes the following desirable characteristics. Without the use of locking bolts and like means, piston guide 4 is constantly urged in the direction of gravity by hydraulic pressure exerted thereon. Even at the instant of molding, piston guide 4 is pressed tightly to inner mold 7 to ensure molding with high accuracy. Cover 17 is provided with sufficient weight and bulk for receiving the upward force of hydraulic pressure thereon while slidably engaging instepped guide 16 provided in housing 5 and moving upwardly thereon at the instant of molding. This arrangement eliminates any need for locking bolts 13 or like means and provides a more durable mold which produces a superior product.

Buffer 21 dampens the impact of the cover 17 against housing 5 when cover 17 slides downwardly on guide 16 to its at rest position. The dampening occurs after completion of the molding cycle and thereby has no adverse effect on molding accuracy.

The retention time for the spontaneously generated hydraulic pressure is short, therefore no specific and complicated means are provided for sealing water in the hydraulically connected operable members of the device, such as upper and lower thrust pistons 2 and 3, and substantially no water leakage is observed in this embodiment, in practice. The absence of sealing means simplifies the construction of the device.

No fastening or locking procedures are required for operating with the embodiment, and molding occurs with minimal upward and downward displacement of the mold cover. The mold therefore has a short molding and recovery cycle, and substantially continuous use thereof may be made.

Figure 6:
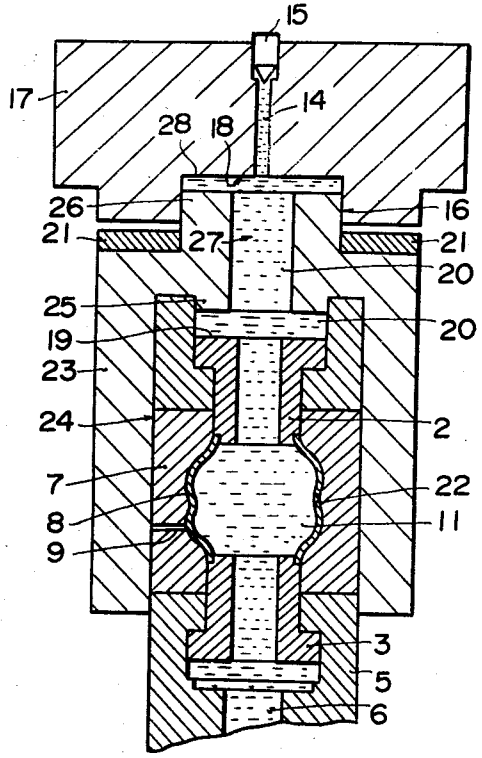
FIG. 6 is a sectional view of the embodiment illustrated in FIG. 5, showing the orientation of parts at the final stage of molding.
Figure 5:
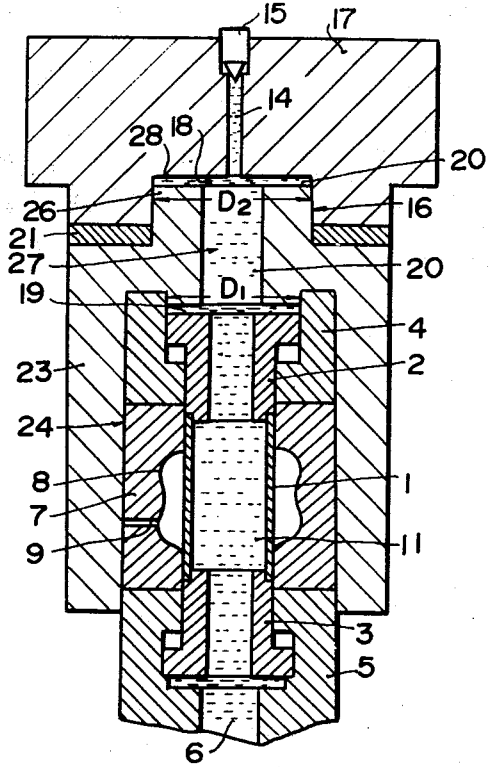
FIG. 5 is a sectional view of another embodiment constructed in accordance with the invention.

Referring now to FIGS. 5 and 6 wherein like numerals identify similar parts having substantially the same functions, inner mold 7 is mounted in an outer frame 23 and along cylindrical interior surface 24 thereof, thereby holding die segments of inner mold 7 in rigid alignment. Frame 23 is provided with a relief 25 which overfits the top edge of piston guide 4 and thereby defines a downstep therein which overfits the mouth of piston guide 4 and has a diameter $D_1$, corresponding to the diameter, $D_1$, of the piston surface which engages it. Relief 25 and the downstep defined in frame 23 thereby, cooperate to form a waterproof seal for piston 2. Frame 23 also includes an instepped guide member 26 having a diameter $D_2$ which is larger than the above mentioned $D_1$ and on which cover 17 is axially slidable in response to a force generated by spontaneous hydraulic pressure in the mold. Cover 17 is provided with a complementary downstepped flange which overlies guide 26 and is slidable thereon for axially sliding cover 17 thereon. An axial hydraulic channel is provided through the frame head and hydraulically connects fluid intake 6 with hydraulic chamber 20. Cover 17 may weight as much as several tons. Cover 17 is provided with a recess 28 for defining interior sidewalls of the downstepped flange on which cover 17 is slidable on corresponding guide 26. The inset bottom wall of cover 17 defining recess 28 overlies the top end of guide 16, and is upwardly displaceable for several millimeters therefrom as cover 17 slides upwardly on guide 26. An air vent channel 14 is provided in cover 17 and has an air escape valve 15 mounted therein. Frame 23 is provided with a buffer 21 mounted on the shoulder thereof for supporting cover 17 on frame 23. Buffer 21 may be fabricated of any suitable resilient material such as rubber, or alternatively, it may comprise a conventional oil pressure damper. The molded article 22 is best seen in FIG. 6.

In practice, the workpiece 1 is mounted in inner mold 7, and frame 23 is mounted on inner mold 7. Cover 17 is mounted over outer frame 23 and rests on buffer 21. Water 11 is charged into the interior of workpiece 1 and hydraulic channel 27 through interiorly connected hydraulic intake channel 6 and air entrapped in the water and corresponding hydraulic channels provided in the device is expelled through air vent 14, as regulated by escape valve 15, which is closed after the air is expelled therefrom. Intense hydraulic pressure, as graphically shown in FIG. 4, is spontaneously generated in water 11 by a hydraulic pressure generator (not shown), whereupon workpiece 1 is deformed in accordance with the shape of mold cavity 8 for thereby providing molded article 22, as best seen in FIG. 6.

As water 11 is pressurized, hydraulic chamber 20 generally defined between the inset wall in cover 17 corresponding to recess 18 and top end 19 of the piston 2 is correspondingly pressurized, whereby relief 25 provided in frame 23 is urged upwardly by the force of hydraulic pressure. Simultaneously therewith, instepped guide member 26 is urged downwardly by the force of that hydraulic pressure. Since $D_2$ is greater than $D_1$, however, frame 23 is always urged downwardly in the direction of gravity by the force. The downward force is not laterally dispersed against inner mold 7, and inner mold 7 is urged downwardly concomitantly therewith.

Cylindrical interior surface 24 of frame 23 is rigidly secured to inner mold 7, therefore, inner mold 7 is rigidly fixed at the instant of molding. Concomitantly therewith mold cavity 8 defined by mated mold sections of inner mold 7 is rigidly fixed for providing an accurately molded article 22. During the molding operation, cover 17 is slidable in response to hydraulic pressure generated in the device in the manner heretofore described in connection with the embodiment shown in FIGS. 2 and 3.

In practice, during the molding operation piston guide 4 is urged downwardly by frame 23 which is urged downwardly, in turn, by hydraulic pressure. Accordingly, the mold 7 is severely compressed thereby, for thereby compensating for any spacings between die segments thereof or between mold 7 and elements adjacent thereto so as to provide an accurately molded article. Frame 23 and cover 17 are releasably connected for obtaining access to mold 7 for thereby facilitating assembly and break-down thereof and for releasing a molded article therefrom. Interior surface 24 of frame 23 is preferably conically shaped for providing a wedge effect for tightly compressing die segments of mold 7 and for providing a construction wherein a small axial displacement of frame 24 provides access to mold 7 and facilitates a change-over thereof. The shape of mold cavity 8 may be varied in accordance with the contour of the molded article, and concomitantly therewith the shape of frame 23 may be correspondingly varied. However if $D_2$ remains constant, cover 17 may be compatibly utilized in connection with these aforementioned construction variations for thereby minimizing the number of changes functionally related to a design change. $D_2$ may be relatively small, therefore, the weight of cover 17 may be minimized.

The following example is set forth for illustrative purposes only, and is not to be treated as limiting the invention, which is defined in the claims.

EXAMPLE

In a molding device of the type shown in FIGS. 5 and 6, the maximum hydraulic pressure therein is 1500 kg/cm², $D_2$=8 cm, $D_1$=6 cm, the weight of covers 17 is 5 tons, and water is charged into the device for 0.004 seconds, as shown in FIG. 4, for generating the hydraulic pressure therein. The upward force exerted against frame 23 is found to be $$1500 \times r/4 \cdot D_1^2 = 28{,}300 \text{ kg};$$

and

The downward force exerted thereon is found to be $$1500 \times r/4 \cdot D_2^2 = 75{,}300 \text{ kg}.$$

Therefore, frame 23 remains stationary since the downward force thereon exceeds the upward force thereon by 47,000 kg. (75,300 − 28,300 kg).

Correspondingly, the maximum upward force exerted on cover 17 is $$1500 \times r/4 \cdot D_2^2 = 75{,}300 \text{ kg},$$

and the average upward force exerted thereon during the pressurizing period of 0.004 seconds may be expressed as 75300/2 = 37650 kg and the upward acceleration thereof may be mathematically determined in the formula as follows, wherein g represents acceleration due to gravity:

$$5 \text{ (tons)}/g \times \text{acceleration} = 37{,}600;$$

and the average upward acceleration of cover is found to be 7.4g.

Therefore, displacement of cover 17 during the 0.004 seconds may be determined as follows:

$$\tfrac{1}{2} \times 7.4g \times 0.004^2 \div 0.06 \text{ cm } (g = 980 \text{ cm/sec.}^2)$$

As thus mathematically determined, the movement of the top lid is about 0.6 mm. for the pressuring period. The upward speed of displacement thereof, however, may be determined as follows:

$$(\text{average acceleration}) \times \text{time} = 7.4g \times 0.004 - 28 \text{ cm/sec.}$$

Therefore, sufficient energy is exerted on cover 17 to raise it to $28^2/2\ g = 0.41$ cm − 4.1 mm. Therefore, the total maximum displacement of cover 17 is $$0.6 + 4.1 = 4.7\text{mm}.$$

As mathematically determined, the upward vertical displacement of cover 17 is less than 5mm. Therefore, no vibration is provided by its return to the original position, after the pressure period is over, if buffer 21 absorbs an impact of about 24 kg (= 5000 × 4.7).

Therefore, if cover 17 weighs 3 tons, then, as mathematically determined:

| | |
|---|---|
| movement of cover 17 during the 0.004 second period is | 1 mm. |
| total displacement thereof is | 13.4 mm. |
| and the absorption capacity of buffer 21 must be | 40 kg. |

It is found that when cover 17 is about 3 tons, the molding device is satisfactory and employment thereof in the molding process is found to be practicable.

Figure 8:
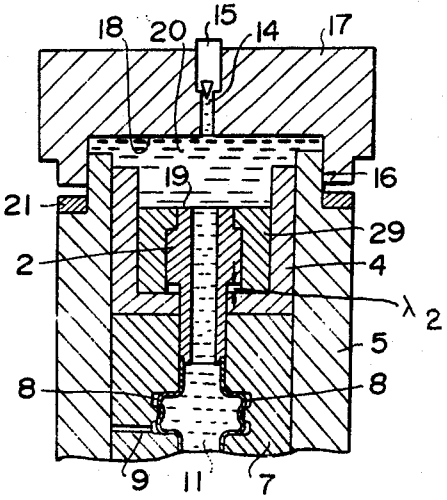
FIG. 8 is a sectional view of the embodiment shown in FIG. 7, the parts thereof being oriented to show their relationship during the molding process.
Figure 7:
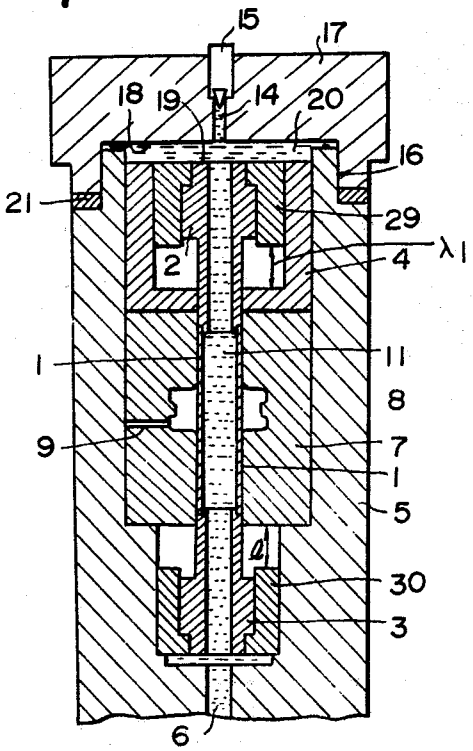
FIG. 7 is a sectional view of yet another embodiment constructed in accordance with the instant invention.
Figure 9:
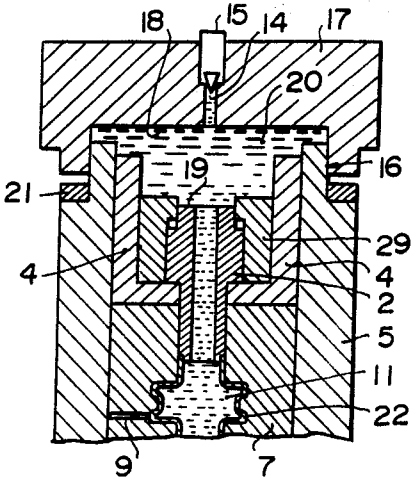
FIG. 9 is a sectional view of the embodiment shown in FIG. 8 wherein the parts are oriented to show their relationship at the final stage of molding.

FIGS. 7–9 illustrate another embodiment of a hydraulic impact molding device constructed in accordance with the instant invention wherein double-thrust pistons are employed in device. Like numerals hereof identify substantially identical elements as numbered in prior embodiments herein.

According to this embodiment, side surface of the thrust pistons and the molding position of the material, corresponding to the operative molding point of the pistons, are predetermined and first and second pistons thereof are respectively automatically provided with a lateral pressure for enhancing the molding effect thereof.

Referring now particularly to FIGS. 7–9, a thrust piston 29 having a large diameter is slidably mounted between side thrust piston 2 and piston guide 4. A corresponding thrust piston 30 is slidably mounted below mold cavity 8.

The hydraulic pressure generated in water 11 impacts against respective lateral exterior surfaces of pistons 2, 3, 29 and 30 for respectively sliding thrust piston 29 together with side thrust piston 2 and thrust piston 30 together with lower side thrust piston 3 for thereby compressing workpiece 1, inwardly. When pistons 29, 30 slide inwardly a predetermined distance $\lambda_1$, piston 29 abuts piston guide 4 and piston 30 abuts the lateral exterior wall of mold 7 and the inward compressive movement thereof is respectively stopped. At this time, workpiece 1 is substantially but not completely molded.

After pistons 29, 30 are stopped side thrust pistons 2 and 3 move a further predetermined distance $\lambda_2$ until the former abuts piston guide 4 and the latter abuts the lateral exterior wall of mold 7.

While pistons 2 and 3 are sliding but pistons 29 and 30 are stationery members of the device facing toward chamber 20 are hydraulically compressed by the force of pressure generated in chamber 20, however, substantially equal but opposite forces are exerted on piston 29. Because the piston guide 4 is downwardly compressed, it compresses mold 7 downwardly for preventing floating of the die segments thereof for thereby holding mold 7 stationary during the molding sequence. Cover 17 is subjected to an upward force on the internal lateral surface 18 thereof, but because of its weight and mass, it is moved upwardly only slightly thereby. As the force of the impact is absorbed, cover 17 falls downwardly onto buffer 21.

This embodiment in accordance with the present invention includes additional advantages as compared with the embodiment best seen in FIGS. 2 and 3. In this embodiment double thrust pistons are employed for providing lateral pressure on the workpiece at the initial stage of molding for increasing compression on the workpiece for deforming it to the conformation of mold cavity 8 and for increasing the molding ratio thereof. The compression promoted by pistons 29, 30 is reduced as they respectively abut piston guide 4 and mold 7, and the workpiece is finally molded by hydraulic pressure exerted on the workpiece interior. It is found that internal mold pressure is more easily monitored and regulated and the amount of pressure in the mold need not be stepped up dramatically at the final stage of molding, which is undesirable. Pressure in the mold may be gradually stepped up for insuring dimensional stability of the molded article.

Moreover, since hydraulic pressure can be stepped up gradually as required, an article having substantially uniform thickness may be molded and the bulge ratio thereof may be enhanced. Buckling and twisting of the workpiece is avoided by adjusting the compression thereon, and the concomitant cost of the operation is reduced. Additionally, the mold is readily releasable for charging and discharging the workpiece and molded article, respectively, therefrom. It is also found that an article may be satisfactorily molded when the embodiment includes a single set of double thrust pistons, as compared with the two sets thereof as seen in FIGS. 7–9.

Figure 10:
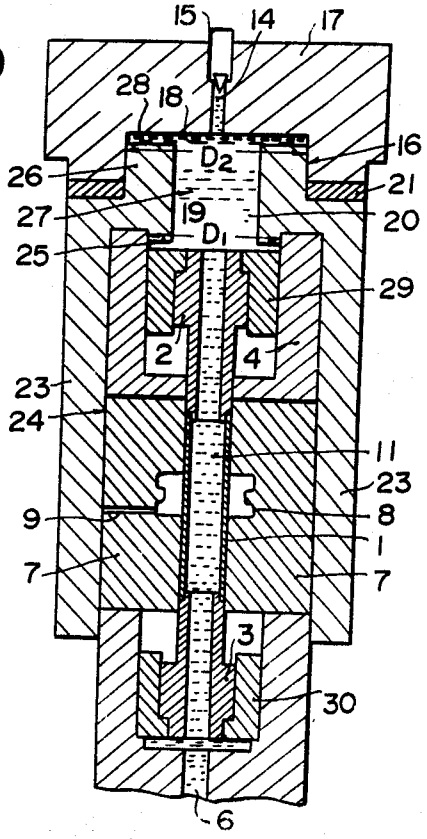
FIG. 10 is a sectional view showing still another embodiment constructed in accordance with the present invention.

FIG. 10 illustrates yet another embodiment constructed in accordance with this invention wherein the hereinabove described double piston action is employed in an embodiment of the type best seen in FIGS. 5 and 6. This embodiment includes the dual operative action of the embodiments seen in FIGS. 5–6 and FIGS. 7–9, respectively.

Figure 11:
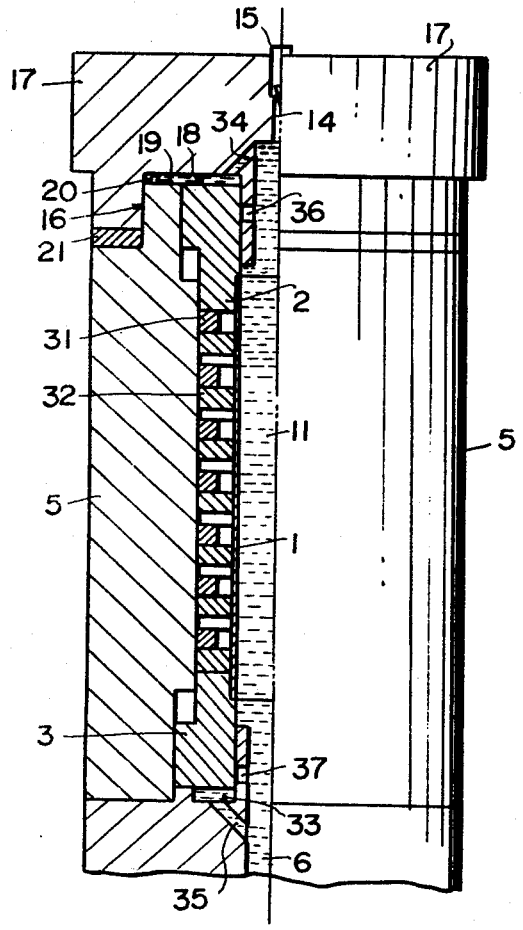
FIG. 11 is a sectional view of another embodiment constructed in accordance with the instant invention.
Figure 12:
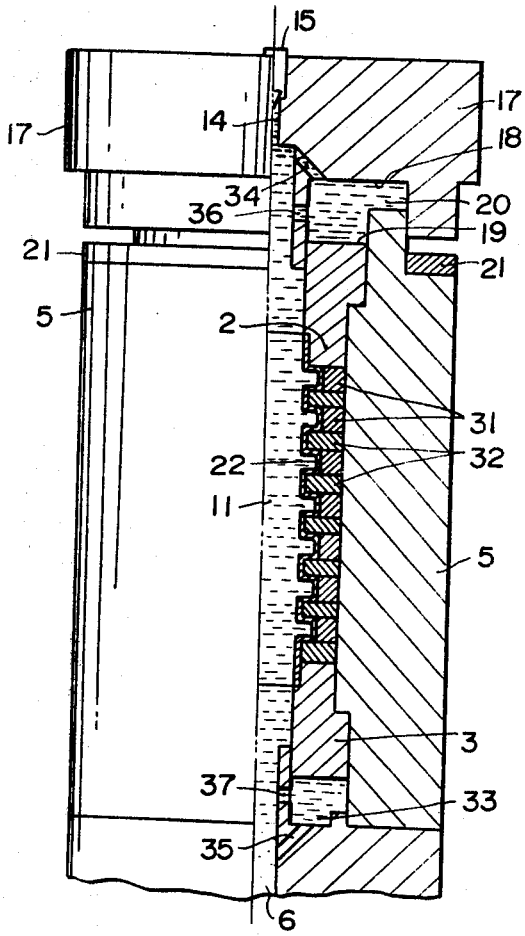
FIG. 12 is a sectional view of the embodiment shown in FIG. 11, the parts of the device being oriented to show their relationship at the final stage of molding.

Referring now to FIGS. 11–12, still another embodiment constructed in accordance with this invention is illustrated and is arranged to mold a screw by hydraulic pressure. A screw-molding device is provided wherein the screw threading is formed by a plurality of springs which are simultaneously axially compressed as the screw is bulge molded so as to permit molding thereof by internal hydraulic pressure. The device includes a slightly mounted thrust piston for laterally deforming the workpiece and the compression thereon may be hydraulically regulated. In the Figures, like parts are identically numbered to correspond with the prior embodiments and Figures therefor.

With reference to the Figures, thrust pistons 2 and 3 are slidably mounted in housing 5 and workpiece 1 is mounted therebetween. Respective pluralities of spring 31 and 32 are alternatively axially mounted on the internal vertical sidewall of the mold. Chambers 20 and 33 are cooperatively connected and are respectively operatively connected to hydraulic passage 6 by respective hydraulic access routes 34 and 35 simultaneously hydraulically compressing pistons 2 and 3.

Respective hydraulic inlets 36 and 37 are normally closed, but are selectively opened at a specific point in the molding sequence as pistons 2 and 3 slide vertically. Springs 31 and 32 have a determined shape and are rectangularly arranged to provide a screw having respective right-hand or left-hand pitches, windings and leads. Springs 31 and 32 are adjacently alternatively mounted to provide a screw shape and to the outer surface thereof is fitted a vertically slidable cylindrical member which is horizontally fixedly connected for instance to the mold, by a key or the like. Springs 32 fittingly correspond to the interior perimeter of workpiece 1, while springs 31 correspond to the thread depths for the molded screw. Elements of the device which are numbered identically with elements of the heretofore described embodiments, function in substantially an identical manner therewith.

To prepare the mold for operation, springs 31 and 32 are mounted in housing 5 and cover 17 is slidably mounted thereon and piston 2 is moved to the position best seen in FIG. 11. After the mold is charged with the workpiece 1, piston 2 is mounted in the mold housing and cover 17 is mounted thereon. At this time the springs 31, 32 are slightly biased. Valve 15 is moved to the open position for exhausting air from the mold interior through air outlet 14. When the mold is fully charged with water, valve 15 is returned to a closed position.

In operation, water 11 is hydraulically pressurized by a hydraulic impact generator and workpiece 1 is spontaneously swollen by the hydraulic pressure. Simultaneously therewith, pistons 2 and 3 are hydraulically accelerated inwardly for vertically compressing workpiece 1 and axially compressing springs 31 and 32. Thus a substantially uniform pressure is applied on workpiece 1 during thread formation thereon. As pistons 2 and 3 slide hydraulically inwardly, they by-pass respective access openings of hydraulic routes 36 and 37 for thereby opening routes 36 and 37, whereby the hydraulic pressure in the mold is increased for compressing springs 31 and 32 until they are integrally biased for forming a screw.

After the molding sequence, cover 17 and piston 2 are removed from the mold housing for access to molded article 22 and springs 31 and 32 which are disassembled therefrom and provide a screw having the desired shape, number of threads and leads.

This embodiment has the advantages that a hydraulically accelerated compressing element promotes molding by means of an internal pressure which is employed for biasing the springs which determine thread formation. Since the springs are uniformly flexible, uniform pressure is exerted thereon. Since the workpiece is deformed while the springs are biased into fixed contact therewith and with the workpiece, a substantially thin cylindrical workpiece may be accurately and precisely molded into a screw.

Production costs and work time are substantially reduced in the use of this embodiment, as compared to conventional cutting methods which employ lathes or thread milling machines. Thread and screw design therefor may be varied by selecting appropriate springs for every screw requirement. For instance, spring selection determines whether the screw is righthanded or lefthanded, the leads and number of threads therefor and the shape thereof. As the workpiece is deformed, the surface thereof is hardened for providing a lightweight screw having a hard surface. It is found that an embodiment having only one slidable piston may be employed with satisfactory results.

Figure 13:
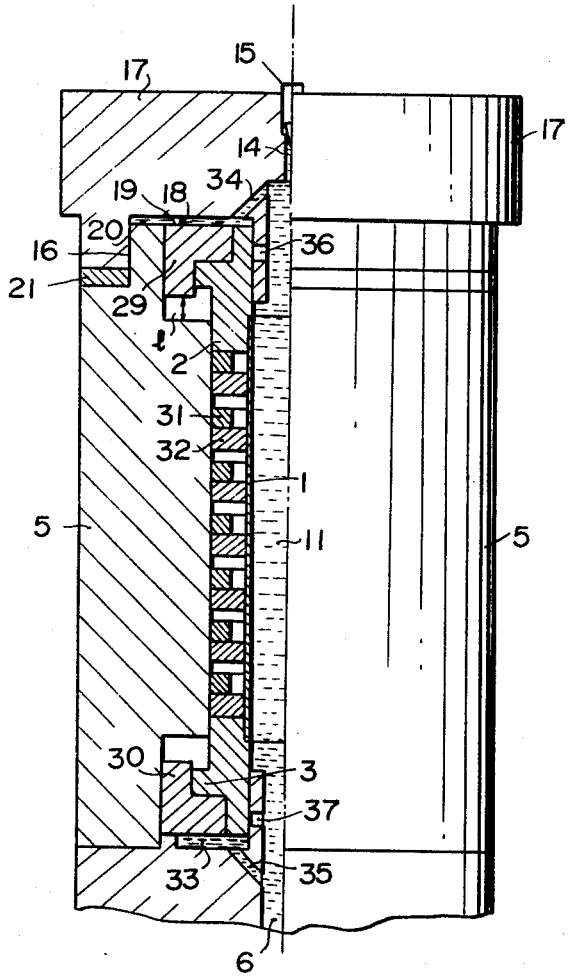
FIG. 13 is a sectional view of a further embodiment constructed in accordance with the present invention.
Figure 14:
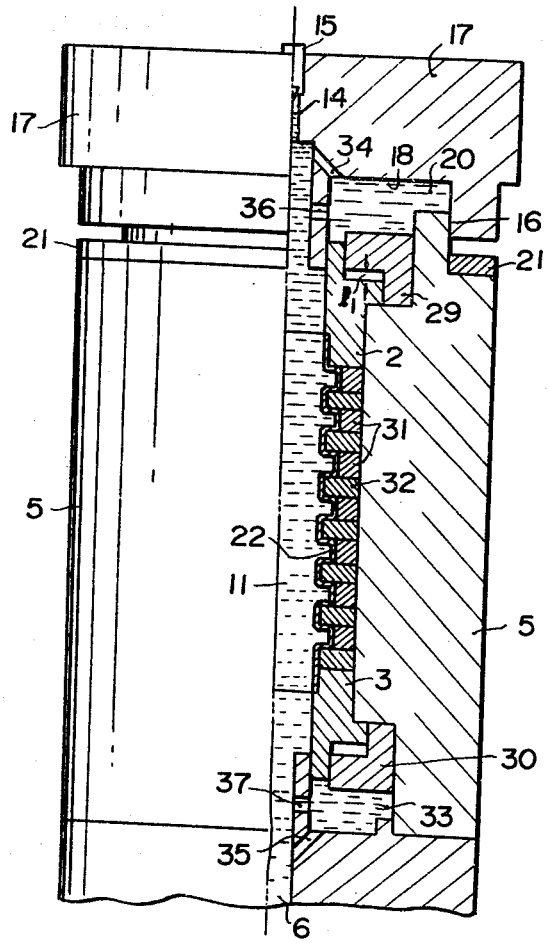
FIG. 14 is a sectional view of the embodiment illustrated in FIG. 13, the parts thereof being oriented to show their relationship at the final stage of molding.

In FIGS. 13 and 14 another embodiment is shown wherein double thrust pistons of the type seen in FIGS. 8 and 9 are employed in the embodiment shown in FIGS. 11 and 12. This embodiment incorporates the advantages of the double thrust piston action into the embodiment of FIGS. 11 and 12.

Referring to FIGS. 13 and 14, cover 17 is slidably mounted on a guide therefor provided in the mold housing and overlies the thrust piston for defining a top chamber for storing a hydraulic liquid between the bottom surface thereof and the upper surface of the upper thrust piston. The molding device is constructed such that the pressured area of movable members facing the top chamber, if there be any, is larger in the downward direction hydraulically than in the upward direction while the cover has only a pressure receiving surface in the upward direction. At the time of molding, therefore, only the cover is subject to the upward force of the hydraulic impact, while all other elements are prevented by the downward force from floating up. The cover further has sufficient mass to absorb the upward impact force at the time of molding of the hydraulic pressure and is displaced slightly upwardly on its guide. When the pressure is released, the downward impact of cover 17 is absorbed on buffer 21.

In this embodiment, the piston guide is constantly hydraulically urged downwardly in the direction of gravity without the use of locking bolts and the like. Even at the instant of molding, the piston guide biases against mold 7 for rigid placement thereof so as to ensure molding with high accuracy. Heavy cover 17 is hydraulically forced upwardly and slides on the mold housing slightly upwardly at the instant of molding. This cover arrangement eliminates locking bolt constructions and the like, and also eliminates such defects as inferior durability and workability. Buffer 21 functions to dampen the impact of the cover at the time it is restored to position and is fixedly mounted between the cover and mold housing. Damping occurs after the molding cycly and thereby causes no adverse effects thereon. Since the retention time of hydraulic pressure in the hydraulic impact generator is short, no substantial leakage of water is observed in engaging portions of the upper thrust piston 2 and the like, thereby eliminating the necessity of specific or complicated means to ensure water proofing.

In general, the molding device in this embodiment does not require any fastening and locking procedures, and operates with only upward and downward motion. For example, it can be operated by a hydraulic pressure generator which activates only the top lid 17. Thus the molding device effectively permits repetitive molding within a short period of time and consequently the molding device is by far more effective and advantageous as compared with customary molding devices. The molding device can be constructed very simply and ruggedly and is very safe to operate. While this embodiment has only generally been described, the operation and construction thereof may be understood with reference to the prior embodiments wherein like numbers correspond to like parts having substantially the same functions.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A hydraulic impact molding device comprising, in combination, a housing, a mold for a hollow workpiece removably mounted in said housing, said mold having a mold cavity therein, first and second coaxial pistons slidably mounted in said housing, said first and second pistons being reciprocably slidable between first and second positions, said first and second pistons being arranged in mirror image relationship at substantially opposite ends of said mold, said mold having first and second piston ports corresponding to said first and second pistons through which said first and second pistons respectively communicate with said mold cavity, said mold cavity being adapted to receive a hollow workpiece having opposite open ends respectively mountable in said first and second piston ports, said first and second pistons correspondingly abutting opposite open ends of a workpiece mounted in said mold cavity, means for hydraulically synchronously sliding said first and second pistons a predetermined distance into said mold cavity through said respective first and second piston ports for axially deforming a workpiece mounted therebetween into the conformation of said mold cavity, means mounted in said housing for limiting the corresponding sliding movement of said first and second pistons into said mold cavity and a cover for said mold, said cover being slidably mounted on said housing and having an axial orientation relative to said mold, said cover being slidable between a first normal position in which said cover is supported on said housing and a second position which is raised relative to said first position, said cover being slidable from said normal first position to said second position substantially at the instant a workpiece is molded in said mold, said cover spontaneously returning to its first normal position after molding.

2. The device as claimed in claim 1 including first guide means mounted on said housing for said cover, and second guide means mounted on said cover, said second guide means being complementary to said first guide means, said cover being slidable between its first and second positions on said respective first and second guide means.

3. The device as claimed in claim 1, including a hydraulic fluid inlet in said housing, respective first and second hydraulic fluid through channels in said corresponding first and second pistons, said first and second channels being substantially aligned over said inlet, said inlet communicating with said first and second hydraulic fluid through channels, means for introducing a hydraulic fluid into said inlet and means for generating an impact in said hydraulic fluid.

4. The device as claimed in claim 1, said cover having a bottom surface overlying said first piston, said first piston said first piston having a corresponding to surface underlying said bottom surface of said cover, and including an expansible hydraulic fluid chamber defined between said top surface of said first piston and the bottom surface of said cover, said first piston being slidable toward said mold cavity as said hydraulic fluid cavity expands for compressing a workpiece mounted in said mold cavity.

5. The device as claimed in claim 2, including a buffer fixedly mounted on said housing said buffer underlying said second guide means and thereby dampening an impact of said slidable cover on said housing as said cover returns to its normal first position.

6. The device as claimed in claim 4, said first piston having a downward pressure receiving surface area which substantially exceeds the upward surface area thereof for hydraulically sliding said first piston inwardly toward said mold cavity.

7. The device as claimed in claim 1, said means mounted in said housing for limiting the corresponding sliding movement of said first and second pistons comprising corresponding respective first and second piston guide members mounted in said housing, said first and second pistons being respectively reciprocally mounted therein.

8. The device as claimed in claim 1, said housing comprising a substantially cylindrical frame overfitting said first piston and said mold.

9. The device as claimed in claim 1 including at least one other piston cooperatively connected to said first or second piston for sliding said operatively connected first or second piston axially toward said mold cavity, a predetermined distance, said at least one other piston having a larger diameter than said first or second piston operatively connected thereto.

10. The device as claimed in claim 1, said mold cavity being defined by respective pluralities of alternatively mounted springs, said springs being axially compressible during the molding sequence.

11. The device as claimed in claim 1, said cover having a sufficient mass for absorbing an upwardly directed hydraulic impact generated within said device and being slightly upwardly axially displaceable thereby substantially instantaneously with molding in said device.

12. The device as claimed in claim 8, said frame having a larger downward pressure receiving surface than a corresponding upward pressure receiving surface thereof.

* * * * *